US005952145A

United States Patent [19]

Yamanaka et al.

[11] Patent Number: 5,952,145

[45] Date of Patent: Sep. 14, 1999

[54] CALIX ARENE CHARGE CONTROL AGENT AND TONER FOR DEVELOPING ELECTROSTATIC IMAGES

[75] Inventors: Shun-ichiro Yamanaka, Hirakata; Kazuaki Sukata, Yawata, both of Japan

[73] Assignee: Orient Chemical Industries, Ltd., Osaka, Japan

[21] Appl. No.: 08/905,585

[22] Filed: Aug. 4, 1997

Related U.S. Application Data

[63] Continuation-in-part of application No. 08/557,967, Nov. 13, 1995, abandoned.

[30] Foreign Application Priority Data

Nov. 11, 1994 [JP] Japan ..... 6-302861

[51] Int. Cl.[6] ..... G03G 9/097

[52] U.S. Cl. ..... 430/110; 430/124

[58] Field of Search ..... 430/110, 124

[56] References Cited

U.S. PATENT DOCUMENTS

| | | | |
|---|---|---|---|
| 5,023,158 | 6/1991 | Tomono et al. | 430/110 |
| 5,049,467 | 9/1991 | Yamanaka | 430/110 |
| 5,350,657 | 9/1994 | Anno et al. . | |
| 5,714,292 | 2/1998 | Anno et al. | 430/110 |

FOREIGN PATENT DOCUMENTS

| | | |
|---|---|---|
| 0 385 580 A1 | 9/1990 | European Pat. Off. . |
| 63-266462 | 11/1963 | Japan . |
| 63-138357 | 6/1988 | Japan . |
| 2-201378 | 8/1990 | Japan . |
| 2-291569 | 12/1990 | Japan . |
| 4-346360 | 12/1992 | Japan . |
| 5-341577 | 12/1993 | Japan . |
| 7-64336 | 3/1995 | Japan . |

OTHER PUBLICATIONS

C. David Gutsche et al. Calixarenes. 4. The Synthesis, Characterization, and Properties of the Calixarene . . . J. Am. Chem. Soc. 1981, 103, 3782–3792.

Report Gendai Kagaku 182, 14–23 (1986).

Suseela Kanamathareddy and C. David Gutsche Synthesis and Conformational Properties of Calix[6]arenes Bridged on the Lower Rim: Self–Anchored Rotaxanes J. am. Chem. Soc. 1993, 115, 6572–6579.

Hideyuki Otsuka Koji Araki and Seiji Shinkai Synthesis of All Possible O–Methylation Products Derivable from 5,11, 17,23,29,35–Hexa–tert–butycalix[6]arene–37,38,39,40,41, 42–hexol J. Org. Chem. 1994, 59, 1542–1547.

Schaffert, R. M. Electrophotography. New York: John Wiley & Sons. pp. 557–562, 1975.

Diamond, Arthur S. (editor). Handbook of Imaging Materials. New York: Marcel–Dekker, Inc. pp. 159–169, 1991.

*Primary Examiner*—Christopher D. Rodee
*Attorney, Agent, or Firm*—McGlew and Tuttle, P.C.

[57] ABSTRACT

Charge control agent and toner for developing electrostatic images comprising such a charge control agent whose active ingredient is a calix (n) arene compound of formula I:

I wherein x+y=n; x and y each is an integer of 1 or more; n is an integer of 4–8; the x repeat units and y repeat units can be arranged in any order; $R^1$ and $R^2$ each is H, $C_{1-12}$ alkyl, $C_{2-12}$ alkenyl, $C_{7-12}$ aralkyl, phenyl, $C_{4-8}$ cycloalkyl, halogen, nitro, amino, alkyl- or phenyl-substituted amino, —$Si(CH_3)_3$, or —$SO_3H$; and of the n R radicals in the —OR groups, 1 to (n−1) are H, with the remaining (n−1) to 1 being alkyl, alkenyl, phenyl, aralkyl, cycloalkyl, —$COR^3$ [wherein $R^3$ is H, alkyl, alkenyl, phenyl, aralkyl, or cycloalkyl], —$Si(CH_3)_3$, —$(CH_2)_mCOOR^4$ [wherein $R^4$ is H or lower alkyl and m is an integer of 1–3], —$(CH_2CH_2O)_rH$ [wherein r is an integer of 1–10], or

[wherein q is an integer of 1–10].

24 Claims, No Drawings

CALIX ARENE CHARGE CONTROL AGENT AND TONER FOR DEVELOPING ELECTROSTATIC IMAGES

CROSS REFERENCE TO RELATED APPLICATION

This is a continuation in part of U.S. application Ser. No. 08/557,967 filed Nov. 13, 1995, abandoned.

BACKGROUND OF THE INVENTION

1. Field of the Invention

The present invention relates to a toner for developing electrostatic images used to develop electrostatic latent images in electrophotography, electrostatic printing and other purposes, and more specifically to a toner for developing electrostatic images that has good fixability and offset resistance, and a charge control agent for controlling the amount of charges of the toner.

2. Description of the Prior Art

In copying machines, printers and other instruments based on electrophotography, various toners containing a coloring agent, a fixing resin (binder resin) and other substances are used to visualize (i.e. develop) the electrostatic latent image formed on the photoreceptor having a light-sensitive layer containing an inorganic or organic photoconductive substance. These toners must show satisfactory performance as to chargeability, fixability, offset resistance, etc.

Chargeability is a key factor in electrostatic latent image-developing systems. Thus, to control appropriately toner chargeability, a charge control agent providing a positive or negative charge is often added to the toner.

Of the conventional charge control agents in actual application or use, those providing a positive charge for the toner include nigrosine dyes and quaternary ammonium salt compounds. Charge control agents providing a negative charge for the toner include chromium complexes of azo dyes and metal complexes (metal salts) of alkyl salicylic acid and hydroxy naphthoic acid.

However, dye type charge control agents lack versatility for use in color toners, although providing good chargeability. Quaternary ammonium salt type charge control agents generally lack environmental resistance under high-temperature high-humidity conditions. Metal complexes or salts with an aromatic hydroxy carboxylic acid or the like as a ligand are inferior to dye type charge control agents in their dispersibility in resin (e.g. toner binder resin).

In recent years, to improve image quality while increasing copying and printing speeds, there has been an increasing demand regarding toner charge properties, such as increased rise speed, and toner fixing properties on recording paper, such as good low-temperature fixability and offset resistance.

However, not a few such conventional charge control agents affect adversely the thermal melting property of the binder resin in the toner, resulting in decreased fixing performance.

There are a number of known toners supplemented with various phenol compounds for the purpose of improving toner fixability and the long-run property or preventing surface-treated carrier deterioration.

For example, Unexamined Japanese Patent Publication No. 138357/1988 discloses a toner containing an oligomer of a phenol compound having an alkyl-substituted amino group. Unexamined Japanese Patent Publication No. 291569/1990 discloses a toner incorporating a compound having a phenolic OH group and a xanthene dye. Unexamined Japanese Patent Publication No. 266462/1988 discloses toners containing a compound such as 2,6-di-tertiary-butyl-4-ethylphenol or 2,2'-methylene-bis-(4-methyl-6-tertiary-butylphenol). However, the developing agents incorporating these toners are unsatisfactory in charging properties.

SUMMARY OF THE INVENTION

It is among the objects of the present invention, developed in view of the above problems in the prior art, to provide a charge control agent which is excellent in charge control property, stability to changes in temperature and humidity, i.e., environmental resistance, and storage stability, which is versatile for use in color toners, including the three subtractive primaries yellow, magenta and cyan colors, good in heat resistance and binder resin affinity, and which insures the excellent fixability and offset resistance of the toner used, and also to provide a toner for developing electrostatic images which is excellent in charge property, environmental resistance and storage stability, which can be used as a toner with various chromatic or achromatic colors and which is excellent in fixability and offset resistance.

Some of the present inventors have developed a charge control agent and toner which are based on a calix (n) arene compound and which are excellent in charge property, environmental resistance, storage stability, etc.; they are disclosed in U.S. Pat. Nos. 5,049,467 and 5,318,883, which correspond to Unexamined Japanese Patent Publication Nos. 201378/1990 and 346360/1992, respectively.

The present inventors have found unexpectedly, according to the present invention, that calix (n) arene compounds, as negative charge control agents, wherein some (but not all) of the n phenolic —OH (hydroxyl) groups have been replaced with —OR groups, are excellent in negative charge control performance and that when used in a toner containing a binder resin, they markedly improve the fixability and offset resistance of the toner.

Accordingly, the negative charge-providing property and charge stability of the calix (n) arene compounds, usable as charge control agents, are attributable to the phenolic —OH groups present in the structure of the calix (n) arene compounds. However, such hydroxyl groups have been found to be faulty in that they interact with the binder resin and other components (e.g., the releasing agent) of the toner, resulting in a narrowed fixing zone of the binder resin.

More specifically, the present inventors have found that a toner having a wide fixing zone, e.g. above 160° C. and up to about 240° C., while maintaining the thermal melting and other properties of the binder resin and the charge property of a calix (n) arene compound, is provided by modifying some of the phenolic —OH groups in the original calix (n) arene compound with alkyl groups, benzyl groups, or the like. Based on this finding, the present inventors developed the present invention.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter and examples in which preferred embodiments of the invention are illustrated.

DETAILED DESCRIPTION OF THE INVENTION

The charge control agent of the present invention contains as an active ingredient a calix (n) arene compound represented by the following general formula I:

I

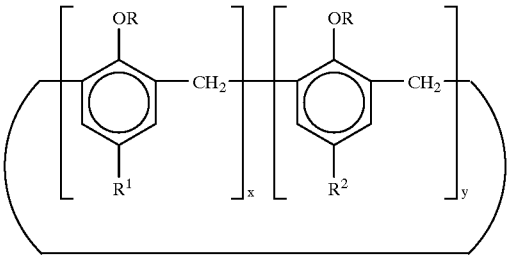

wherein the sum of x and y is n, x and y each representing an integer of 1 or more, and n representing an integer from 4 to 8, particularly 6 or 8;

the repeat units in a number of x and those in a number of y can be arranged in any order; and $R^1$ and $R^2$ each independently represent hydrogen, an alkyl group having 1 to 12 carbon atoms that is branched or not branched (unbranched), an alkenyl group having 2 to 12 carbon atoms that is branched or unbranched; an aralkyl group having 7 to 12 carbon atoms that has or does not have a nuclear or ring substituent (i.e. which is unsubstituted or ring substituted), a phenyl group that has or does not have a nuclear substituent (i.e. which is unsubstituted or ring substituted), a cycloalkyl group having 4 to 8 ring carbon atoms, halogen, a nitro group, an amino group, an alkyl-(e.g. having 1 to 4 carbon atoms) or phenyl- substituted amino group, $—Si(CH_3)_3$ (i.e. a trimethylsilyl group), or $—SO_3H$ (i.e. a sulfo group).

Of the R radicals in the —OR groups in a number of n, 1 to (n−1) are hydrogen, the remaining (n−1) to 1 being Z.

Z represents an alkyl group that is branched or not branched (e.g. an alkyl group having 1 to 12 carbon atoms that is branched or unbranched), an alkenyl group that is branched or not branched (e.g. an alkenyl group having 2 to 12 carbon atoms that is branched or unbranched such as allyl or isobutenyl), a phenyl or aralkyl group that has or does not have a nuclear substituent (e.g. an unsubstituted or ring substituted phenyl or aralkyl group where the aralkyl group has 7 to 12 carbon atoms), a cycloalkyl group (e.g. having 4 to 8 carbon atoms), $—COR^3$ [wherein $R^3$ represents hydrogen, an alkyl group (e.g. having 1–12 carbon atoms) that is branched or not branched, an alkenyl group (e.g. having 2 to 12 carbon atoms) that is branched or not branched such as an allyl or isobutenyl group), a phenyl or aralkyl group that has or does not have a nuclear substituent (e.g. an unsubstituted or ring substituted phenyl or aralkyl group where the aralkyl group has 7 to 12 carbon atoms), or a cycloalkyl group (e.g. having 4 to 8 ring carbon atoms)], $—Si(CH_3)_3$, $—(CH_2)_mCOOR^4$ [wherein $R^4$ represents hydrogen or a lower alkyl group (e.g. having 1 to 4 carbon atoms) and m represents an integer from 1 to 3], $—(CH_2CH_2O)_rH$ [wherein r represents an integer from 1 to 10], or the following:

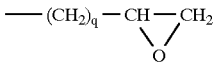

wherein q represents an integer from 1 to 10, i.e. oxacyclopropyl alkyl (or epoxyalkyl or ethylene oxide substituted alkyl) having 1 to 10 carbon atoms in the alkyl radical.

The toner of the present invention for developing electrostatic images comprises the above-described charge control agent, a coloring agent and a binder resin.

(A) According to one aspect of the invention, the toner comprises a calix (n) arene compound of formula I wherein $R^1$ is identical with $R^2$, R in a number of x repeat units being hydrogen and R in a number of y repeat units being Z.

(B) According to another aspect of the invention, the toner comprises a calix (n) arene compound of formula I wherein $R^1$ is not identical with $R^2$, R in a number of x repeat units being hydrogen, and R in a number of y repeat units being Z. In formula I, the substituent —OR of the benzene nucleus having $R^1$ is —OH, and the substituent —OR of the benzene nucleus having $R^2$ is —OZ.

(C) According to still another aspect of the invention, the toner comprises a calix (n) arene compound of formula I wherein $R^1$ is not identical with $R^2$, R in a number of x repeat units being hydrogen, R in a number of (y-b) of the y repeat units being hydrogen, R in a number of b of the y repeat units being Z, and b representing an integer of 1 to 6. In formula I, the substituent —OR of the benzene nucleus having $R^1$ is —OH, and the substituent —OR of the benzene nucleus having $R^2$ is —OH or —OZ.

(D) According to a further aspect of the invention, the toner comprises a calix (n) arene compound of formula I wherein $R^1$ is not identical with $R^2$, R in a number of x repeat units being Z, R in a number of (y-b) of the y repeat units being hydrogen, and R in a number of b of the y repeat units being Z, b representing an integer of 1 to 6. In formula I, the substituent —OR of the benzene nucleus having $R^1$ is —OZ, and the substituent —OR of the benzene nucleus having $R^2$ is —OH or —OZ.

(E) According to a still further aspect of the invention, the toner comprises a calix (n) arene compound of formula I wherein $R^1$ is not identical with $R^2$, R in a number of (x-a) of the x repeat units being hydrogen, R in a number of a of the x repeat units being Z, R in a number of (y-b) of the y repeat units being hydrogen, and R in a number of b of the y repeat units being Z, a and b each representing an integer of 1 to 5. In formula I, the substituent —OR of the benzene nucleus having $R^1$ is —OH or —OZ, and the substituent —OR of the benzene nucleus having $R^2$ is —OH or —OZ.

(F) According to yet another aspect of the invention, the toner comprises a mixture of two or more varieties of calix (n) arene compounds of formula I wherein x and y represent various (different) numbers.

(G) According to yet another aspect of the invention, the toner comprises a mixture of two or more varieties of calix (n) arene compounds of formula I wherein the numbers of —OH groups as —OR groups are various (different).

(H) According to a yet further aspect of the invention, the toner comprises a mixture of two or more varieties of calix (n) arene compounds of formula I wherein x and y represent various (different) numbers, the numbers of —OH groups as —OR groups being various (different).

The charge control agent of the present invention is good in dispersibility in the toner binder resin, excellent in charge control performance, environmental resistance, storage stability and durability, and causes almost no color deterioration in toner images even when added to various chromatic or achromatic toners, and does not adversely affect the fixability and offset resistance conferred by the binder resin, releasing agent, etc., used in the toner; therefore, it insures the fixability and offset resistance, especially the excellent high-temperature offset resistance, of the toner used.

In addition, by containing this negative charge control agent, the toner of the present invention for developing electrostatic images is excellent in chargeability, environmental resistance and storage stability, causes almost no color deterioration in toner images even when used to obtain various chromatic or achromatic colors, and does not affect adversely the fixability and offset resistance conferred by the binder resin, releasing agent, etc., used in the toner; therefore, it is excellent in fixability and offset resistance, especially high-temperature offset resistance.

Calix (n) arene compounds have a cyclic structure similar to that of cyclodextrin, and can, for example, be obtained at high yields when prepared from the starting materials phenol and formaldehyde, especially in the presence of concentrated alkali.

Zinke et al. found that reacting phenol and formaldehyde in the presence of sodium hydroxide yields a high melting point substance (calixarene). Later, Gutsche et al. presented a detailed report on the production, structure and physical properties of various calix (n) arene derivatives [J. Am. Chem. Soc., 103, 3782 (1981)].

With respect to the calix (n) arene compounds of the above formula I as active ingredient of the charge control agent of the present invention, $R^1$ and $R^2$ are exemplified by hydrogen;

alkyl groups having 1 to 12 carbon atoms that are branched or not branched, such as methyl, ethyl, propyl, isopropyl, n-butyl, tert-butyl, isoamyl, octyl, tert-octyl, 2-ethylhexyl and dodecyl;

alkenyl groups having 2 to 12 carbon atoms that are branched or not branched such as allyl, isobutenyl, etc.;

aralkyl groups having 7 to 12 carbon atoms that have or do not have (one or more, e.g. 1 to 4) nuclear or ring substituents (e.g., alkyl and/or alkoxy groups having 1 to 4 carbon atoms), such as benzyl, $—CH(CH_3)—C_6H_5$, $—C(CH_3)_2—C_6H_5$, $—CH_2CH_2—C_6H_5$, $—CH_2—CH_2—(_6H_4—CH_3$, $—CH_2—C_6H_4—OCH_3$ and naphthylmethyl;

phenyl groups that have or do not have (one or more, e.g. 1 to 4) nuclear or ring substituents (e.g., alkyl, haloalkyl and/or alkoxy groups having 1 to 4 carbon atoms, and/or halogen), such as phenyl, tolyl, xylyl, p-chlorophenyl, trifluoromethylphenyl and methoxyphenyl;

alicyclic groups (alicyclic saturated hydrocarbon groups) including cycloalkyl groups, e.g. having 4 to 8 ring carbon atoms, such as cyclohexyl and cycloheptyl;

halogen such as chlorine, bromine, iodine and fluorine atoms;

nitro groups;

amino groups;

alkyl- (e.g., alkyl or alkoxy groups having 1 to 4 carbon atoms) or phenyl- substituted amino groups;

$—Si(CH_3)_3$ (i.e. trimethylsilyl groups), and $—SO_3H$ (i.e. sulfo groups).

Furthermore, the corresponding R radicals of the calix (n) arene compounds of formula I are exemplified by hydrogen;

alkyl groups having 1 to 12 carbon atoms that are branched or not branched, such as methyl, ethyl, propyl, isopropyl, n-butyl, tert-butyl, isoamyl, octyl, tert-octyl, 2-ethylhexyl and dodecyl, particularly those having 1 to 4 carbon atoms;

alkenyl groups having 2 to 12 carbon atoms that are branched or not branched such as allyl, isobutenyl, etc.;

phenyl groups that have or do not have (one or more, e.g. 1 to 4) nuclear or ring substituents (e.g., alkyl, haloalkyl and/or alkoxy groups having 1 to 4 carbon atoms, and/or halogen), such as phenyl, tolyl, xylyl, p-chlorophenyl, trifluoromethylphenyl and methoxyphenyl;

aralkyl groups having 7 to 12 carbon atoms that have or do not have (one or more, e.g. 1 to 4) nuclear or ring substituents (e.g., alkyl and/or alkoxy groups having 1 to 4 carbon atoms), such as benzyl, $—CH(CH_3)—C_6H_5$, $—C(CH_3)_2—C_6H_5$, $—CH_2CH_2—C_6H_5$, $—CH_2—C_6H_4—CH_3$, $—CH_2—C_6H_4—OCH_3$ and naphthylmethyl;

alicyclic groups (alicyclic saturated hydrocarbon groups) including cycloalkyl groups, e.g. having 4 to 8 ring carbon atoms, such as cyclohexyl and cycloheptyl;

carbonyl groups including formyl (—CHO) and substituted carbonyl (—CO—) groups substituted by alkyl groups (alkanoyl), e.g. having 1 to 12 carbon atoms, phenyl groups (benzoyl) having or not having (one or more, e.g. 1 to 4) nuclear or ring substituents (e.g. alkyl and/or alkoxy groups having 1 to 4 carbon atoms), aralkyl groups (aralkanoyl), e.g. having 7 to 12 carbon atoms, having or not having (one or more, e.g. 1 to 4) nuclear or ring substituents (e.g. alkyl and/or alkoxyl groups having 1 to 4 carbon atoms), alkenyl groups (alkenoyl) having 2 to 12 carbon atoms such as allyl groups, or alicyclic groups (alicyclic saturated hydrocarbon groups) including cycloalkyl groups (cycloalkylcarbonyl), e.g. having 4 to 8 ring carbon atoms, such as $—COCH_3$ (acetyl), $—COC_2H_5$, $—COC_6H_5$, $—COCH_2C_6H_5$, $—COC_6H_4—CH_3$, $—COC_6H_4—OCH_3$, $—COCH_2CH=CH_2$ or $—COC_6H_{11}$ (cyclohexyl);

$—Si(CH_3)_3$;

$—CH_2COOR^4$, $—(CH_2)_2COOR^4$, or $—(CH_2)_3COOR^4$ (wherein $R^4$ represents a hydrogen (carboxyalkyl) or a lower alkyl (alkoxycarbonylalkyl) group having 1 to 4 carbon atoms, such as methyl, ethyl, propyl, isopropyl or n-butyl);

ethylene oxide groups represented by $—(CH_2CH_2O)_rH$ (wherein r represents an integer from 1 to 10); and epoxyalkyl groups represented by the formula

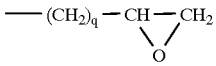

wherein q represents an integer from 1 to 10 (i.e. oxacyclopropyl alkyl having 1 to 10 carbon atoms in the alkyl radical, particularly 2,3-epoxypropyl).

Calix (n) arene compounds and derivatives thereof can be synthesized in accordance with the methods described in a large number of references, including the report presented in Gendai Kagaku, 182, 14–23 (1986). Synthesis of a calix (n) arene compound (of general formula I above) relating to the present invention by modifying some (but less than all) of the hydroxyl groups (phenolic —OH groups) can be achieved by the methods described in references such as J. Am. Chem. Soc., 115, 6572–6579 (1993) and J. Org. Chem. 1994, 59, 1542–1547.

A calix (n) arene compound of general formula I above, which is an active ingredient of the charge control agent of the present invention, can, for example, be synthesized as follows:

First, a cyclic n-mer (which may be a mixture of n-mers of different n numbers) represented by the following structural formula A (original or starting calix (n) arene compound) is synthesized by an ordinary method of synthesis (wherein x, y, $R^1$ and $R^2$ have the same definitions as those given for general formula I above).

A

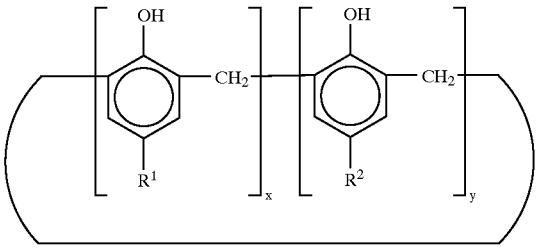

The calix (n) arene compound thus obtained and an alkali [e.g., $K_2(CO_3)$, NaH, NaF, CsF, $BaO/Ba(OH)_2$] are refluxed in an organic solvent [e.g., methyl isobutyl ketone (MIBK), methyl ethyl ketone, acetone, xylene, toluene, dimethylformamide, and the like] for not less than 5 hours, preferably 6 to 10 hours, after which a desired halide (e.g., methyl bromide, methyl iodide, ethyl iodide, n-butyl bromide, amyl bromide, benzyl bromide ($C_6H_5CH_2$—Br), allyl bromide ($CH_2$=CH—$CH_2$—Br), isobutenyl chloride ($(CH_3)_2C$=$CH_2$—Cl), benzoyl chloride ($C_6H_5CO$—Cl), toluoyl chloride ($CH_3$—$C_6H_4CO$—Cl), anisoyl chloride ($CH_3O$—$C_6H_4CO$—Cl), acetyl chloride ($CH_3CO$—Cl), octyl bromide, dodecyl chloride, epichlorhydrin (i.e. 1-chloro-2,3-epoxy propane), and the like), diethylene oxide tosyl ($HO(CH_2CH_2O)_2$—$SO_2$—$C_6H_4$—$CH_3$), trimethylsilyl chloride ($(CH_3)_3Si$—Cl), methyl chloro-acetate ($CH_3$—OOC—$CH_2$—Cl), etc., followed by reaction under reflux conditions for not less than 10 hours, preferably 15 to 30 hours.

After being allowed to cool at room temperature, the reaction mixture is subjected to suction filtration; the resulting filtrate is evaporated to dryness under reduced pressure. The resulting residue is recrystallized, reprecipitated, or otherwise treated using chloroform/n-hexane or an alcohol such as methanol, to yield a calix (n) arene compound of general formula I of the present invention.

Examples of the calix (n) arene compounds of the present invention and example syntheses thereof are given below, but are not to be construed as limitative on, but rather only as illustrative of, the calix (n) arene compounds of the present invention. All parts and percentages (%) therein are by weight unless otherwise specifically indicated.

SYNTHESIS EXAMPLE 1

Synthesis of Example Compound 1

After 12.96 g (0.01 mol) of p-tert-butyl calix (8) arene and 4.14 g (0.03 mol) of potassium carbonate were refluxed in 100 ml of methyl isobutyl ketone (MIBK) for 8 hours, 5.1 g (0.03 mol) of benzyl bromide were added, followed by reaction under refluxing conditions for 30 hours. After being allowed to cool at room temperature, the reaction mixture was subjected to suction filtration; the resulting filtrate was evaporated to dryness under reduced pressure. This residue was recrystallized from chloroform/n-hexane to yield 8.1 g of a white powder (Example Compound 1) (recovery 58.5%) having a melting point of 205 to 210° C.

SYNTHESIS EXAMPLE 2

Synthesis of Example Compound 6

After 12.96 g (0.01 mol) of p-tert-butyl calix (8) arene and 4.14 g (0.03 mol) of potassium carbonate were refluxed in 100 ml of methyl isobutyl ketone (MIBK) for 6 hours, 4.8 g (0.03 mol) of allyl bromide were added, followed by reaction under refluxing conditions for 17 hours. After being allowed to cool at room temperature, the reaction mixture was subjected to suction filtration; the resulting filtrate was evaporated to dryness under reduced pressure. This residue was recrystallized from methanol to yield 9.8 g of a yellowish white powder (Example Compound 6) (yield 71.2%) having a melting point of 145 to 153° C.

SYNTHESIS EXAMPLE 3

Synthesis of Example Compound 5

0.5 mol of p-tert-butyl phenol, 0.5 mol of tert-octyl phenol, 1.2 mol of p-formaldehyde and 1.0 g of potassium hydroxide were reacted under reflux conditions in 500 ml of xylene for 7 hours while water was removed, to yield 15.2 g (0.01 mol) of a calix (8) arene mixture. After 4.14 g (0.03 mol) of potassium carbonate was refluxed in 100 ml of methyl isobutyl ketone (MIBK) for 8 hours, 5.1 g (0.03 mol) of benzyl bromide were added, followed by reaction under refluxing conditions for 10 hours. After being allowed to cool at room temperature, the reaction mixture was subjected to suction filtration; the resulting filtrate was evaporated to dryness under reduced pressure. This residue was recrystallized from methanol to yield 9.0 g of a light yellowish white powder (Example Compound 5) (yield 55.9%) having a melting point of 169 to 172° C.

SYNTHESIS EXAMPLE 4

Synthesis of Example Compound 7

After 12.96 g (0.01 mol) of p-tert-butyl calix (8) arene and 6.9 g (0.05 mol) of potassium carbonate were refluxed in 100 ml of methyl isobutyl ketone (MIBK) for 1 hour, 5.6 g (0.06 mol) of epichlorhydrin were added, followed by reaction under refluxing conditions for 12 hours. After being allowed to cool at room temperature, the reaction mixture was subjected to suction filtration; the resulting filtrate was evaporated to dryness under reduced pressure. This residue was reprecipitated from chloroform/n-hexane; the resulting precipitate was collected by filtration, washed and dried to yield 8.3 g of a white powder (Example Compound 7) (yield 56.7%) having a melting point of 315 to 320° C.

SYNTHESIS EXAMPLE 5

Synthesis of Example Compound 15

After 12.96 g (0.01 mol) of p-tert-butyl calix (8) arene and 1.57 g (0.01 mol) of potassium carbonate were refluxed in 100 ml of acetone for 3 hours, 4.42 g (0.03 mol) of methyl iodide were added, followed by reaction under refluxing conditions for 30 hours. After being allowed to cool at room temperature, the reaction mixture was dispersed in 3500 ml of water and stirred for 1 hour, after which it was filtered. The residue collected by the filtration was washed with water and evaporated to dryness under reduced pressure; this residue was reprecipitated with chloroform/n-hexane. The resulting precipitate was collected by filtration and dried to yield 11.5 g of a light yellowish white powder (Example Compound 15) (yield 74.2%) having a melting point of 235 to 243° C.

The example compounds obtained by the above-described example syntheses and other example compounds synthesized by methods similar to the above-described methods are given below. With respect to the following example compounds, units in parentheses are arranged circularly in any optional order.

Example Compound 1
1
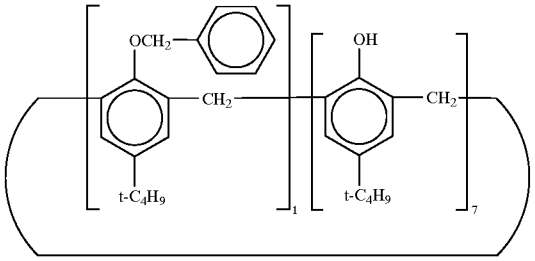
Example Compound 2
2
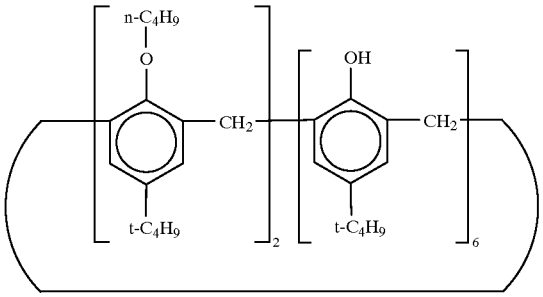
Example Compound 3
3
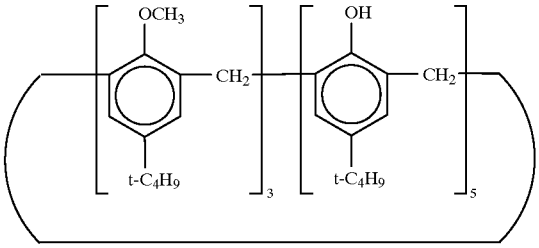
Example Compound 4
4
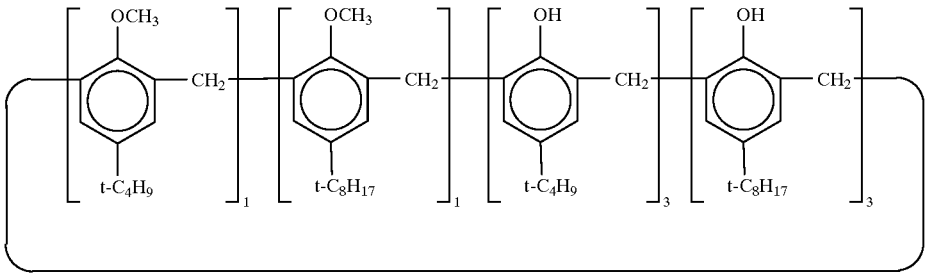

Example Compound 5
5
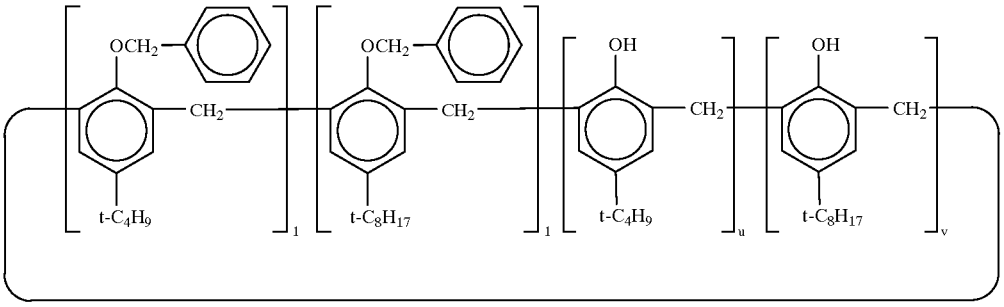
(Example Compound 5 is a mixture of compounds wherein u and v each represent an integer from 0 to 6, and the sum of u and v is 6.)
Example Compound 6
6
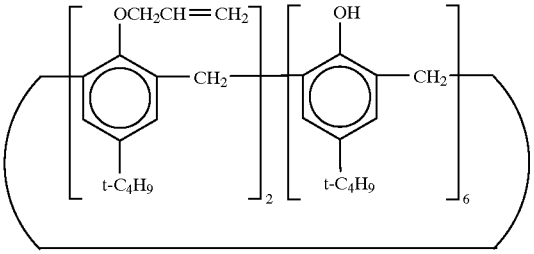
Example Compound 7
7
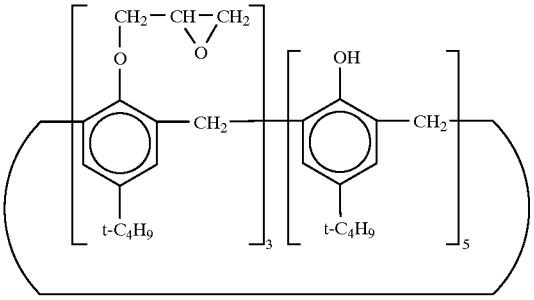
Example Compound 8
8
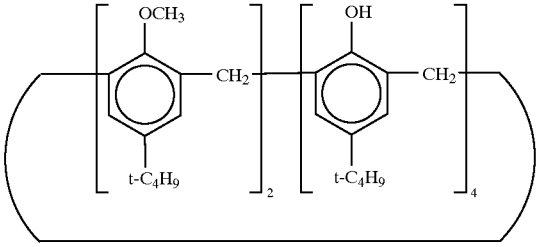
Example Compound 9
9
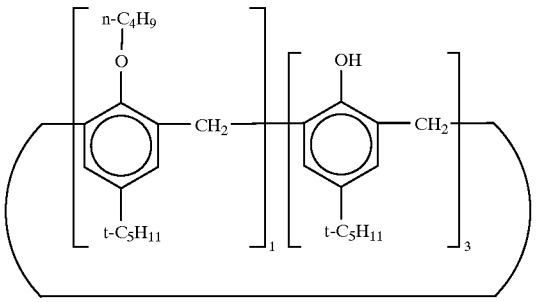

Example Compound 10
10
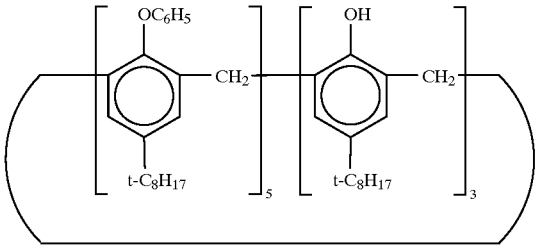
Example Compound 11
11
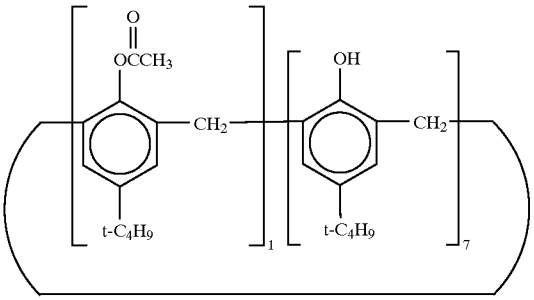
Example Compound 12
12
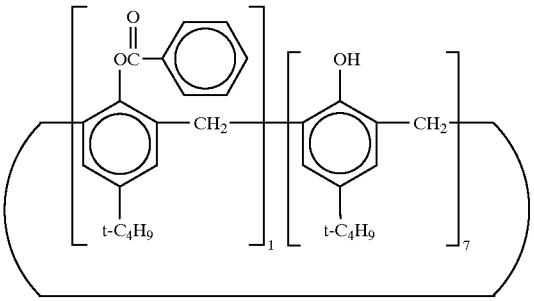
Example Compound 13
13
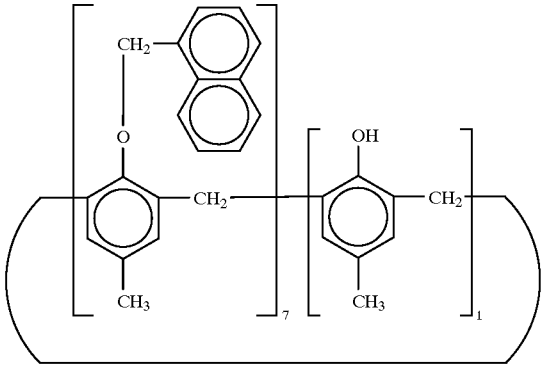
Example Compound 14
14
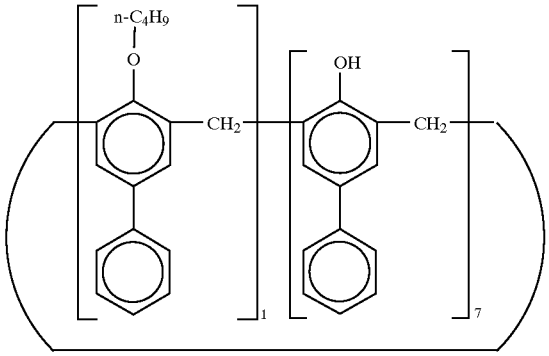
Example Compound 15
15
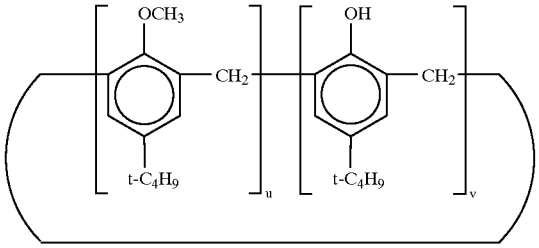
(Example Compound 15 is a mixture of compounds wherein u represents an integer from 1 to 3, v represents an integer from 5 to 7, and the sum of u and v is 8.)

Example Compound 16

16

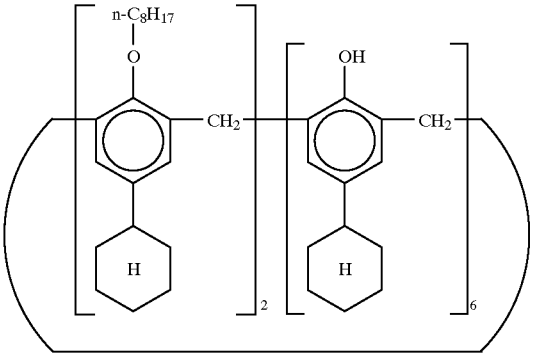

Example Compound 17

17

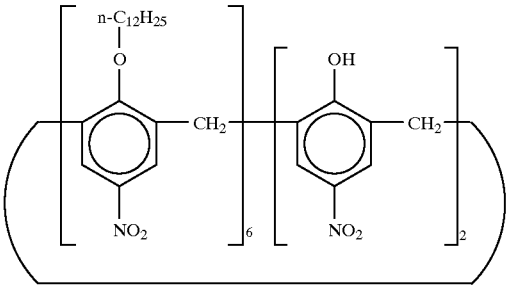

Example Compound 18

18

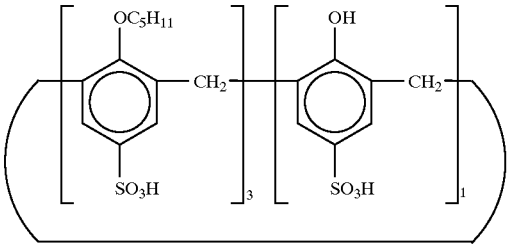

Example Compound 19

19

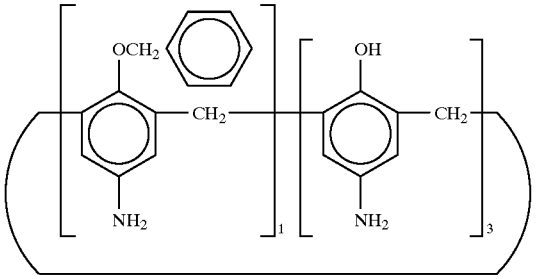

Example Compound 20

20

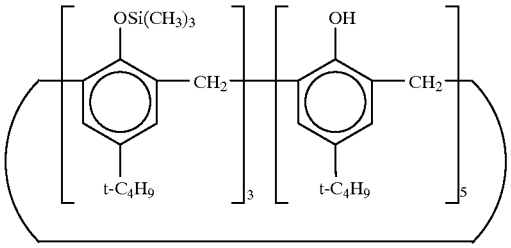

Example Compound 21

21

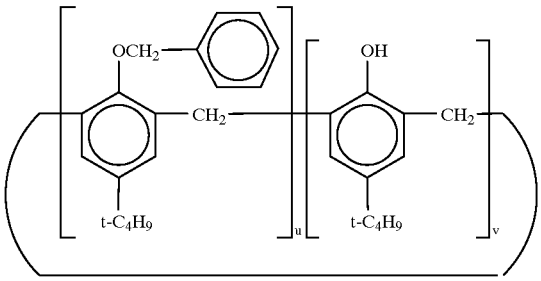

(Example Compound 21 is a mixture of compounds wherein u represents an integer from 0 to 3, v represents an integer from 5 to 8, and the sum of u and v is 8, such mixture including at least one compound having at least one but less than all hydroxy groups, i.e. at least one compound in which at least one u unit must be present such that u represents an integer from 1 to 3 and v represents an integer from 5 to 8, and the sum of u and v is 8, said at least one compound preferably comprising at least about 70% by weight of the mixture of compounds.)

Example Compound 22

22

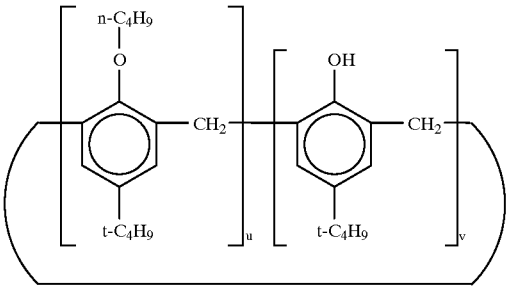

(Example Compound 22 is a mixture of compounds wherein u represents an integer from 0 to 3, v represents an integer from 5 to 8, and the sum of u and v is 8, such mixture including at least one compound having at least one but less than all hydroxy groups, i.e. at least one compound in which at least one u unit must be present such that u represents an integer from 1 to 3 and v represents an integer from 5 to 8, and the sum of u and v is 8, said at least one compound preferably comprising at least about 70% by weight of the mixture of compounds.)

Example Compound 23

23

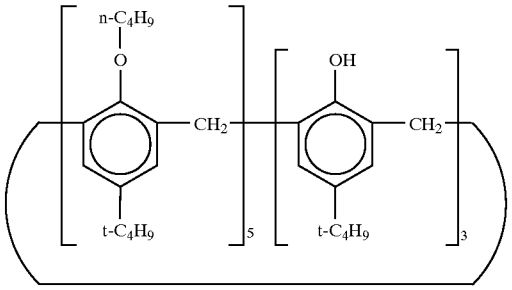

Example Compound 24

24

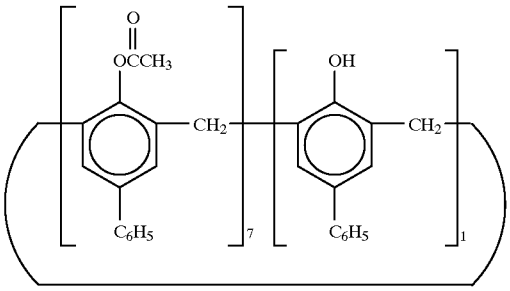

The toner of the present invention for developing electrostatic images may contain one or more kinds of the above-described charge control agents of the present invention. The toner of the present invention may also contain the original calix (n) arene compound [calix (n) arene wherein all —OR groups in general formula I are —OH groups as shown in formula A], as long as the objects of the present invention are accomplished. Specifically, the objects of the present invention can be accomplished, even when the original calix (n) arene compound (of formula A) is contained at content ratios of not more than about 30% by weight of the total calix (n) arene compound content, in addition to the calix (n) arene compound (of formula I) of the present invention.

It is desirable that the toner of the present invention for developing electrostatic images contain the calix (n) arene compound, as a charge control agent, of the present invention in a ratio of 0.1 to 10 parts by weight per 100 parts by weight of binder resin. More preferably, the content ratio is 0.5 to 5 parts by weight per 100 parts by weight of binder resin.

To improve toner quality, conventional additives such as electroconductive grains, fluidity-improving agents (i.e. fluidizing agents), releasing agents and image peeling-preventing agents may be added internally or externally.

Examples of resins used in the toner of the present invention include the following known binder resins for use in toners. Specifically, styrene resin, styrene-acrylic resin, styrene-butadiene resin, styrene-maleic acid resin, styrene-vinyl methyl ether resin, styrene-methacrylic acid ester copolymer, phenol resin, epoxy resin, polyester resin, polypropylene resin, paraffin wax, etc., may be used singly or in blends.

For preferable use of a binder resin for toners in a toner for full-color imaging by subtractive mixing or for OHP (overhead projectors), etc., the binder resin is required to be transparent, substantially colorless (such that no tone damage or deterioration occurs in the toner image) and compatible with the charge control agent of the present invention.

Also, the binder resin is required to have a desired thermal melting property, elasticity, fluidity, and other properties, so as to meet the requirements regarding toner fixability to paper upon melting, toner offset resistance for a heat roller, and toner blocking resistance during storage. Examples of such resins for preferable use include acrylic resin, styrene-acrylic resin, styrene-methacrylic acid ester copolymer and polyester resin.

The toner of the present invention may incorporate various known dyes or pigments as coloring agents, which may be used singly or in combination.

Examples of pigments as coloring agents include organic pigments such as Quinophthalone Yellow, Hansa Yellow, Isoindolinone Yellow, Perinone Orange, Perillene Maroon, Rhodamine 6G Lake, Quiacridone Red, Anthanthrone Red, Rose Bengale, copper Phthalocyanine Blue, copper Phthalocyanine Green and diketopyrrolopyrrole pigments; and inorganic pigments such as Carbon Black, Titanium White, Titanium Yellow, Ultramarine, Cobalt Blue and Red Iron Oxide.

Examples of dyes as coloring agents for preferable use in color toners include various oil-soluble or disperse dyes such as azo dyes, quinophthalone dyes, anthraquinone dyes, phthalocyanine dyes, indophenol dyes and indoaniline dyes; and xanthene and triarylmethane dyes modified with resins such as rosin, rosin-modified phenol and maleic acid.

Dyes and pigments having a good spectral property can be preferably used to prepare a toner of the three primaries for full-color imaging. Chromatic monocolor toners may incorporate an appropriate combination of a pigment and dye of the same color tone (e.g., quinophthalone pigment and dye, xanthene or Rhodamine pigment and dye, phthalocyanine pigment and dye, and the like).

The toner of the present invention for developing electrostatic images is, for example, produced as follows:

A dry negatively chargeable toner having an average grain size (particle size) of 5 to 20 μm can be obtained by thoroughly mixing a binder resin and coloring agent as described above, the charge control agent of the present invention, and, if necessary, a magnetic material, a fluidizing agent and other additives, using a ball mill or another mechanical mixer, subsequently kneading the mixture in a molten state using a hot kneader such as a heat roll, kneader or extruder, cooling and solidifying the mixture, and then pulverizing the solid and classifying the resulting particles.

Other usable methods include the method in which the starting materials, such as a coloring agent and the charge control agent of the present invention, are dispersed in a binder resin solution and then spray dried, and the polymerizing toner production method in which a given set of starting materials are mixed in a monomer for the binder resin to yield an emulsified suspension, which is then polymerized to yield the desired toner.

When the toner of the present invention is used as a two-component developer, development can be achieved by the two-component magnetic brush developing precess or the like using the toner in admixture with a carrier powder.

Any known carrier can be used. Examples of the carrier, e.g. powder, include iron powder, nickel powder, ferrite powder and glass beads (powder) about 50 to 200 μm in particle size, and such materials as coated with acrylic acid ester copolymer, styrene-acrylic acid ester copolymer, styrene-methacrylic acid ester copolymer, silicone resin, polyamide resin, ethylene fluoride resin or the like.

When the toner of the present invention is used as a one-component developer, fine powder of a ferromagnetic material such as iron powder, nickel powder or ferrite powder may be added and dispersed in preparing the toner as described above. Examples of developing processes which can be used in this case include contact development and jumping development.

EXAMPLES

The present invention is hereinafter described in more detail by means of the following examples, which are not to be construed as limitative on, but rather only as illustrative of, the present invention. In the description below, all "part(s) by weight" are referred to as "part(s)" for short. As used herein, all parts and percentages (%) are by weight unless otherwise specifically indicated.

Example 1

100 parts—Styrene-acrylic copolymer resin [HIMER SMB600 (trade name), produced by Sanyo Kasei Co., Ltd.], 10 parts—Low polymer polypropylene [Biscal 550P (trade name), produced by Sanyo Kasei Co., Ltd.], 7 parts—Carbon black [MA-100 (trade name), produced by Mitsubishi Chemical Industries, Ltd.], and 2 parts—Charge control agent (Example Compound 1).

The above ingredients (119 parts) were uniformly premixed using a high-speed mixer, and then kneaded in a molten state using an extruder, cooled, and roughly milled in a vibration mill. The obtained coarse product was finely pulverized using an air jet mill equipped with a classifier to yield a negatively chargeable black toner 10 to 20 μm in particle size.

Five parts of this toner were mixed (triboelectrically charged) with 95 parts of an iron powder carrier [TEFV 200/300 (trade name), produced by Powdertech —Co., Ltd.] to yield a developer; initial chargeability and fixability were then determined. The results are shown in Table I.

When this developer was used for repeated cycles of actual imaging, high-quality black images free of density reduction and fogging were obtained, with good charge stability (narrow variation in the amount of charges) and sustainability.

Initial chargeability: The amount of initial blowoff charges of the developer was determined under normal (standard) conditions (25° C. air temperature, 50% relative humidity), low temperature—low humidity conditions (5° C. air temperature, 30% relative humidity), and high temperature—high humidity conditions (35° C. air temperature, 90% relative humidity). The same applies to all the working examples and comparative examples shown below.

Fixability: The developer was set on a commercial electro-photographic copying machine of which the fixing device had been modified. With the copying machine, an actual imaging experiment was conducted at various heat roller fixing temperatures to identify the temperature range within which good fixing performance was achieved without the offset phenomenon to the fixing heat roller (offset free zone).

Example 2

A toner and developer according to the present invention were prepared in the same manner as in Example 1, except that the charge control agent used in Example 1 was replaced with Example Compound 6 obtained in Synthesis Example 2; initial chargeability and fixability were determined. The results are shown in Table 1.

Example 3

A toner and developer according to the present invention were prepared in the same manner as in Example 1, except that the charge control agent used in Example 1 was replaced with Example Compound 5 obtained in Synthesis Example 3; initial chargeability and fixability were determined. The results are shown in Table 1.

Example 4

100 parts—Polyester resin [HP-301 (trade name), produced by The Nippon Synthetic Chemical Industry, Co., Ltd.], 10 parts—Low polymer polypropylene [Biscal 550P (trade name), produced by Sanyo Kasei Co., Ltd.], 3 parts—Rhodamine dye [Oil Pink #312 (trade name), produced by Orient Chemical Industries Ltd.], 3 parts—Quinacridone Red, and 2 parts—Charge control agent (Example Compound 6).

The above ingredients (118 parts) were treated in the same manner as in Example 1 to yield a negatively chargeable toner, which was then used to prepare a developer. The initial chargeability and fixability of this developer were determined. The results are shown in Table 1.

When this developer was used for repeated cycles of actual imaging, high-quality magenta images free of density reduction and fogging were obtained, with good charge stability and sustainability.

Example 5

100 parts—Styrene-acrylic copolymer resin [HIMER SMB600 (trade name), produced by Sanyo Kasei Co., Ltd.], 10 parts—Low polymer polypropylene [Biscal 550P (trade name), produced by Sanyo Kasei Co., Ltd.], 2 parts—Copper phthalocyanine dye [VALIFAST Blue 2606 (trade name), produced by Orient Chemical Industries Ltd.], 3 parts—Copper phthalocyanine pigment, and 2 parts—Charge control agent (Example Compound 15).

The above ingredients (117 parts) were treated in the same manner as in Example 1 to yield a negatively chargeable toner, which was then used to prepare a developer. The initial chargeability and fixability of this developer were determined. The results are shown in Table 1.

When this developer was used for repeated cycles of actual imaging, high-quality cyan images free of density reduction and fogging were obtained, with good charge stability and sustainability.

Example 6

A toner and developer according to the present invention were prepared in the same manner as in Example 5, except that the charge control agent used in Example 5 was replaced with Example Compound 8. The initial chargeability and fixability of this developer were determined. The results are shown in Table 1.

Example 7

100 parts—Styrene-acrylic copolymer resin [HIMER SMB600 (trade name), produced by Sanyo Kasei Co., Ltd.], 10 parts—Low polymer polypropylene [Biscal 550P (trade name), produced by Sanyo Kasei Co., Ltd.], 3 parts—Hydroxyquinophthalone dye [C. I Disperse Yellow 64], and 2 parts—Charge control agent (Example Compound 22).

The above ingredients (115 parts) were treated in the same manner as in Example 1 to yield a negatively chargeable toner, which was then used to prepare a developer. The initial chargeability and fixability of this developer were determined. The results are shown in Table 1.

When this developer was used for repeated cycles of actual imaging, high-quality yellow images free of density reduction and fogging were obtained, with good charge stability and sustainability.

Example 8

100 parts—Styrene-2-ethylhexyl methacrylate copolymer resin (80/20), 50 parts—iron tetroxide [EPT-500 (trade name), produced by Toda Kogyo Corporation, 10 parts—Low polymer polypropylene [Biscal 550P (trade name), produced by Sanyo Kasei Co., Ltd.], 6 parts—Carbon black [MA-100 (trade name), produced by Mitsubishi Chemical Industries, Ltd.], and 2 parts—Charge control agent (Example Compound 7).

The above ingredients (168 parts) were uniformly premixed using a ball mill to yield a pre-mix, which was then kneaded in a molten state at 180° C. using a twin-screw extruder, cooled, and thereafter roughly crushed, finely pulverized and classified to yield a one-component toner having a particle size range from 5 to 15 $\mu$m.

When this toner was used on a commercial copying machine to form toner images, fog-free high-quality images with good thin-line reproducibility were obtained.

Example 9

A toner and developer according to the present invention were prepared in the same manner as in Example 1, except that the charge control agent used in Example 1 was replaced with Example Compound 23; initial chargeability and fixability were determined. The results are shown in Table 1.

Example 10

A toner and developer according to the present invention were prepared in the same manner as in Example 1, except that the charge control agent used in Example 1 was replaced with Example Compound 24; initial chargeability and fixability were determined. The results are shown in Table 1.

Comparative Example 1

To compare chargeability and fixability, a black toner was prepared in the same manner as in Example 1, except that the charge control agent of the present invention used in Example 1 (Example Compound 1) was replaced with the p-tert-butyl calix (8) arene compound (phenolic —OH groups not modified) used in Synthesis Example 1 as a starting material for Example Compound 1; initial chargeability and fixability were determined.

Although no marked difference was noted in terms of initial chargeability, the developer was found to be likely to undergo the offset phenomenon at high temperatures, with a narrow offset-free zone. The results are shown in Table 1.

Comparative Example 2

A comparative toner was prepared in the same manner as in Example 1, except that the charge control agent of the present invention used in Example 1 (Example Compound 1) was replaced with a p-cyclohexyl calix (8) arene compound (phenolic —OH groups not modified); initial chargeability and fixability were determined. The results are shown in Table 1.

Comparative Example 3

A comparative toner was prepared in the same manner as in Example 1, except that the charge control agent of the present invention used in Example 1 (Example Compound 1) was replaced with a p-methyl calix (8) arene compound (phenolic —OH groups not modified); initial chargeability and fixability were determined. The results are shown in Table 1.

Comparative Example 4

A comparative toner was prepared in the same manner as in Example 1, except that the charge control agent of the present invention used in Example 1 (Example Compound 1) was replaced with a p-phenyl calix (8) arene compound (phenolic —OH groups not modified); initial chargeability and fixability were determined. The results are shown in Table 1.

Comparative Example 5

A comparative toner was prepared in the same manner as in Example 4, except that the charge control agent of the present invention used in Example 4 (Example Compound 6) was replaced with a p-tert-butyl calix (8) arene compound (phenolic —OH groups not modified); initial chargeability and fixability were determined. The results are shown in Table 1.

Comparative Example 6

A comparative toner was prepared in the same manner as in Example 8, except that the charge control agent of the present invention used in Example 8 (Example Compound 7) was not used. This comparative toner was evaluated as unacceptable because of image sputtering, blurs and fogging.

TABLE 1

| | Initial Chargeability (μC/g) | | | |
|---|---|---|---|---|
| | Standard Conditions | High-Temperature High-Humidity | Low-Temperature Low-Humidity | Fixability (° C.) (Offset-Free Zone) |
| Example 1 | −21.5 | −21.0 | −21.7 | 120–240 |
| Example 2 | −23.3 | −22.5 | −23.8 | 120–240 |
| Example 3 | −25.1 | −24.9 | −25.6 | 120–240 |
| Example 4 | −35.6 | −33.9 | −35.9 | 120–240 |
| Example 5 | −20.3 | −20.1 | −20.9 | 120–240 |
| Example 6 | −26.2 | −25.5 | −26.4 | 120–240 |
| Example 7 | −25.7 | −25.2 | −25.8 | 120–240 |
| Example 8 | — | — | — | 120–240 |
| Example 9 | −17.5 | −17.2 | −17.7 | 120–240 |
| Example 10 | −18.9 | −18.6 | −19.0 | 120–240 |
| Comparative Example 1 | −22.2 | −21.3 | −22.6 | 120–160 |
| Comparative Example 2 | −20.3 | −19.8 | −20.4 | 120–135 |
| Comparative Example 3 | −19.4 | −19.1 | −19.6 | 120–140 |
| Comparative Example 4 | −23.1 | −23.0 | −23.5 | 140–160 |
| Comparative Example 5 | −38.1 | −37.5 | −38.4 | 130–150 |
| Comparative Example 6 | — | — | — | 140–160 |

With respect to Table 1, the Example 1 toner uses Example Compound 1 wherein 1 of the 8 phenolic —OH groups is replaced by benzyl (—$CH_2C_6H_5$), which provides an initial chargeability of at least about −15 μC/g, and more particularly at least about −20 μC/g, in conjunction with an offset-free, wide fixing zone of −120–240° C. spanning a range of 120° C. In contrast thereto, the Comparative Example 1 toner uses the original (starting) phenolic —OH containing calix (8) arene compound of formula A, which provides an offset-free, narrow fixing zone of only 120–160° C. spanning a narrow range of only 40° C., despite the fact that it also provides an initial chargeability of at least about −15 μC/g, and more particularly at least about −20 μC/g.

Thus, according to the present invention, the toner may be readily fixed at an elevated temperature above 160° C. and up to about 240° C., e.g. from about 161° C. up to about 240° C., spanning a wide range of about 79° C., enabling the electrostatic latent image to be efficiently developed at an initial chargeability of at least about −15 μC/g, and more particularly at least about −20 μC/g, and then rapidly fixed by the heated fixing roller at an elevated fixing temperature exceeding 160° C. and up to about 240° C. in offset-free manner.

The toners of Examples 2–10, which respectively contain other —OR substituent group containing calix (n) arene compounds according to the present invention, all achieve the same offset-free, wide fixing zone of 120–240° C. spanning a range of 120° C. in conjunction with an initial chargeability of at least about −15 μC/g (Examples 9–10), and more particularly at least about −20 μC/g (Examples 2–8).

In contrast thereto, the toners of Comparative Examples 2–5, each using an original phenolic —OH containing calix (n) arene compound of formula A, all provide a narrow fixing zone of only 120–135° C. spanning a 15° C. range per Comparative Example 2, of only 120–140° C. spanning a 20° C. range per Comparative Example 3, of only 140–160° C. spanning a 20° C. range per Comparative Example 4, and of only 130–150° C. spanning a 20° C. range per Comparative Example 5.

Even though the initial chargeability of the toners of Comparative Examples 2–5, like that of Comparative Example 1, is at least about −15 μC/g, and more particularly at least about −20 μC/g, the fixing temperature results of Comparative Examples 2–5, like that of Comparative Example 1, are comparable to that of the control toner of Comparative Example 6 which omits any calix (n) arene compound and still provides a narrow fixing zone of 140–160° C. spanning a 20° C. range.

On the other hand, according to the present invention, the toner may be readily fixed at an elevated fixing temperature above 160° C. and up to about 240° C., spanning a wide range of about 79° C., in conjunction with an initial chargeability of at least about −15 μC/g, and more particularly at least about −20 μC/g, e.g. about −15 to −40 μC/g and more particularly −20 to −40 μC/g, for efficient electrostatic image development and rapid fixing at a fixing temperature above 160° C., e.g. 161–240° C., in offset-free manner.

In order to demonstrate the criticality of the toner of the present invention over the prior art, i.e. wherein all of the phenolic —OH groups for —OR in the calix (n) arene compound of formula I have been replaced by —OZ groups, the following experiments corresponding to Example 1 were conducted.

Experiment a 100 parts—Styrene-acrylic copolymer resin [HIMER SMB600 (trade name), produced by Sanyo Kasei Co., Ltd.], 10 parts—Low polymer polypropylene [Biscal 550P (trade name), produced by Sanyo Kasei Co., Ltd.], 7 parts—Carbon black [MA-100 (trade name), produced by Mitsubishi Chemical Industries, Ltd.], and 2 parts—Charge control agent.

The charge control agent is a calix (n) arene compound corresponding to formula I wherein the sum of x and y is 8, and R is benzyl (—$CH_2C_6H_5$), but in which each of $R^1$ and $R^2$ is tert-butyl (t—$C_4H_9$).

The above ingredients (119 parts) were uniformly premixed using a high speed mixer, and then kneaded in a molten state using an extruder, cooled, and roughly milled in a vibration mill. The obtained coarse product was finely pulverized using an air jet mill equipped with a classifier to yield a negatively chargeable black toner 10 to 20 μm in particle size.

Five parts of this toner were mixed with 95 parts of an iron powder carrier [TEFV 200/300 (trade name), produced by Powdertech Co., Ltd.] to yield a developer; initial chargeability and fixability were then determined. The results are shown in Table 2.

Initial chargeability: The amount of initial blowoff charges of the developer was determined under normal (standard) conditions (25° C. air temperature, 50% relative humidity), low temperature—low humidity conditions (5° C. air temperature, 30% relative humidity), and high temperature - high humidity conditions (35° C. air temperature, 90% relative humidity).

Fixability: The developer was placed in a commercial electrophotographic copying machine of which the fixing device had been modified. With the copying machine, an actual imaging experiment was conducted at various heat roller fixing temperatures to identify the temperature range within which good fixing performance was achieved without the offset phenomenon to the fixing heat roller (offset free zone).

Experiment b

A toner and developer were prepared in the same manner as in Experiment a, except that the charge control agent used in Experiment a was replaced with a calix (8) arene compound corresponding to formula I wherein the sum of x and y is 8, R is benzyl ($—CH_2C_6H_5$), but in which $R^1$ is tert-butyl ($t—C_4H_9$) and $R^2$ is tert-octyl ($t—C_8H_{17}$); initial chargeability and fixability were determined. The results are shown in Table 2.

Experiment c

A toner was prepared in the same manner as in Experiment a, except that the charge control agent used in Experiment a was replaced with a calix (8) arene compound corresponding to formula I wherein the sum of x and y is 8 and R is allyl ($—CH_2CH=CH_2$), but in which each of $R^1$ and $R^2$ is tert-butyl ($t—C_4H_9$); initial chargeability and fixability were determined. The results are shown in Table 2.

Experiment d

A toner was prepared in the same manner as in Experiment a, except that the charge control agent used in Experiment a was replaced with a calix (8) arene compound corresponding to formula I wherein the sum of x and y is 8 and R is octyl ($—C_8H_{17}$), but in which each of $R^1$ and $R^2$ is cyclohexyl ($—C_6H_{11}$); initial chargeability and fixability were determined. The results are shown in Table 2.

TABLE 2

| Expt. | (OR (OR | $R^1)_x$ $R^2)_y$ | n | Initial Chargeability ($\mu$C/g) Std. Cond. | High Temp. High Humid. | Low Temp. Low Humid. | Fixability (° C.) (Offset Free Zone) | (° C.) Range |
|---|---|---|---|---|---|---|---|---|
| a | (O-benzyl | t-butyl)$_8$ | 8 | −9.6 | −9.2 | −10.1 | 120–240 | 120 |
| b | (O-benzyl | t-butyl)$_x$ | 8 | −9.9 | −9.8 | −10.3 | 120–240 | 120 |
| | (O-benzyl | t-octyl)$_y$ | | | | | | |
| | sum of x and y = 8 | | | | | | | |
| c | (O-allyl | t-butyl)$_8$ | 8 | −8.1 | −8.0 | −8.9 | 120–240 | 120 |
| d | (O-octyl | cyclohexyl)$_8$ | 8 | −8.5 | −8.0 | −8.7 | 120–240 | 120 |

It is seen from Table 2 that when all of the —OR groups are substituted, e.g. with benzyl ($—CH_2C_6H_5$), allyl ($—CH_2CH=CH_2$) or octyl ($—C_8H_{17}$), such that no phenolic —OH groups remain unsubstituted, the fully phenolic —OH group substituted calix (n) arene compound used as charge control agent in the toner fails to provide a developer with an adequate initial chargeability, such at best being at most about 10 $\mu$C/g, and particularly less than about 11 $\mu$C/g, even though the offset phenomenon at high temperatures is avoided at a wide fixing zone of 120–240° C. which spans a 120° C. range (Experiments a–d).

Specifically, the initial chargeability is only about −8.0 to −10.3 $\mu$C/g, and particularly for standard conditions is only about −8.1 to −9.9 $\mu$C/g, for high temperature—high humidity conditions is only about −8.0 to −9.8 $\mu$C/g, and for low temperature—low humidity conditions is only about −8.7 to −10.3 $\mu$C/g.

In contrast thereto, as shown in Table 1, according to the present invention wherein less than all of such phenolic —OH groups are substituted, the partially phenolic —OH group substituted calix (n) arene compound used in the toner provides a developer with an adequate initial chargeability of at least about −15 $\mu$C/g, and more particularly at least about −20 $\mu$C/g, while at the same time avoiding the offset phenomenon at high temperatures at a wide fixing zone of 120–240° C. which spans a 120° C. range (Examples 1–10), and more particularly an elevated temperature fixing zone above 160° C. and up to 240° C., e.g. from about 161° C. up to about 240° C., which spans such a range of about 79° C.

On the other hand, as also shown in Table 1, when none of such phenolic OH groups are substituted, the unsubstituted phenolic —OH group containing calix (n) arene compound of formula A used in the toner provides a developer with an adequate initial chargeability but which is prone to the offset phenomenon resulting in a narrow fixing zone of at best only 120–160° C. spanning a range of at most 40° C. (Comparative Examples 1–5), like the control (Comparative Example 6).

It is believed that the prior art does not suggest nor set forth examples of using a mixture of —OH groups and —OZ groups in the same calix (n) arene compound, nor suggest that such a mixture of —OH groups and —OZ groups provides improved fixability and offset resistance resulting in an offset-free, wide fixing zone in conjunction with a high initial chargeability for excellent charge control performance for the corresponding toner as contemplated by the present invention (Examples 1–10), compared to the performance of such a calix (n) arene compound in which none of the phenolic —OH groups have been substituted (Comparative Examples 1–6, Table 1) and such a calix (n) arene compound in which all of the phenolic —OH groups have been substituted, e.g. by —OZ groups (Experiments a–d, Table 2).

The benefits provided by the improved properties of the toner (and developer) according to the present invention are unexpected, as the performance of the original calix (n) arene compounds of formula A and any —OR substituent group containing compounds would have been expected to conform to the results of Comparative Examples 1–5 per Table 1, if not to the results of Experiments a–d per Table 2.

This may be appreciated from the combined results of Tables 1 and 2 as shown in Table 3 below.

TABLE 3

| Ex. | Ex. Cmpd. | (OR<br>(OR | $R^1)_x$<br>$R^2)_y$ | n | Initial Chargeability (μC/g)<br>Std. Cond. | High Temp. High Humid. | Low Temp. Low Humid. | Fixability (° C.) (Offset Free Zone) | (° C.) Range |
|---|---|---|---|---|---|---|---|---|---|
| 1 | 1 | (O-benzyl<br>(OH | t-butyl)$_1$<br>t-butyl)$_7$ | 8 | −21.5 | −21.0 | −21.7 | 120–240 | 120 |
| 2 | 6 | (O-allyl<br>(OH | t-butyl)$_2$<br>t-butyl)$_6$ | 8 | −23.3 | −22.5 | −23.8 | 120–240 | 120 |
| 3 | 5 | (O-benzyl<br>(O-benzyl<br>(OH<br>(OH | t-butyl)$_1$<br>t-octyl)$_1$<br>t-butyl)$_u$<br>t-octyl)$_v$ | 8 | −25.1 | −24.9 | −25.6 | 120–240 | 120 |
| | | | | | (u + v each = 0–6, sum of u + v = 6) | | | | |
| 4 | 6 | (O-allyl<br>(OH | t-butyl)$_2$<br>t-butyl)$_6$ | 8 | −35.6 | −33.9 | −35.9 | 120–240 | 120 |
| 5 | 15 | (O-methyl<br>(OH | t-butyl)$_u$<br>t-butyl)$_v$ | 8 | −20.3 | −20.1 | −20.9 | 120–240 | 120 |
| | | | | | (u = 1–3, v = 5–7, sum of u + v = 8) | | | | |
| 6 | 8 | (O-methyl<br>(OH | t-butyl)$_2$<br>t-butyl)$_4$ | 6 | −26.2 | −25.5 | −26.4 | 120–240 | 120 |
| 7 | 22 | (O-butyl<br>(OH | t-butyl)$_u$<br>t-butyl)$_v$ | 8 | −25.7 | −25.2 | −25.8 | 120–240 | 120 |
| | | | | | (u = 0–3, v = 5–8, sum of u + v = 8) | | | | |
| 8 | 7 | (2,3-epoxy-propyl<br>(OH | t-butyl)$_3$<br>t-butyl)$_5$ | 8 | — | — | — | 120–240 | 120 |
| 9 | 23 | (O-butyl<br>(OH | t-butyl)$_5$<br>t-butyl)$_3$ | 8 | −17.5 | −17.2 | −17.7 | 120–240 | 120 |
| 10 | 24 | (O-acetyl<br>(OH | phenyl)$_7$<br>phenyl)$_1$ | 8 | −18.9 | −18.6 | −19.0 | 120–240 | 120 |
| Comp. Ex. | | | | | | | | | |
| 1 | | (OH | t-butyl)$_8$ | 8 | −22.2 | −21.3 | −22.6 | 120–160 | 40 |
| 2 | | (OH | cyclohexyl)$_8$ | 8 | −20.3 | −19.8 | −20.4 | 120–135 | 15 |
| 3 | | (CH | methyl)$_8$ | 8 | −19.4 | −19.1 | −19.6 | 120–140 | 20 |
| 4 | | (CH | phenyl)$_8$ | 8 | −23.1 | −23.0 | −23.5 | 140–160 | 20 |
| 5 | | (CH | t-butyl)$_8$ | 8 | −38.1 | −37.5 | −38.4 | 130–150 | 20 |
| 6 | | Control - No calix (n) arene compound | | | | | | 140–160 | 20 |
| Expt. | | | | | | | | | |
| a | | (O-benzyl | t-butyl)$_8$ | 8 | −9.6 | −9.2 | −10.1 | 120–240 | 120 |
| b | | (O-benzyl<br>(O-benzyl | t-butyl)$_x$<br>t-octyl)$_y$ | 8 | −9.9 | −9.8 | −10.3 | 120–240 | 120 |
| | | | | | | (sum of x and y = 8) | | | |
| c | | (O-allyl | t-butyl)$_8$ | 8 | −8.1 | −8.0 | −8.9 | 120–240 | 120 |
| d | | (O-octyl | cyclohexyl)$_8$ | 8 | −8.5 | −8.0 | −8.7 | 120–240 | 120 |

It will be noted that Examples 2–3 and 9–10, Comparative Examples 1–4 and Experiments a–d are like Example 1, whereas Example 4 and Comparative Example 5 differ from Example 1 in using a different binder resin and coloring agent, Examples 5–6 differ from Example 1 in using different coloring agents, Example 7 differs from Example 1 in using a different coloring agent, Example 8 differs from Example 1 in using a different binder resin and providing a one component toner (developer), and Comparative Example 6 is like Example 8 but omits any calix (n) arene compound and serves as a control.

As the charging method for a one-component toner (Example 8 and Comparative Example 6) is different from the charging method for a two-component toner (Examples 1–7 and 9–10, and Comparative Examples 1–5), the initial chargeability data for Example 8 is not meaningful in the given comparison.

According to the present invention, therefore, a toner is provided for developing and fixing electrostatic images, which has improved fixability and offset resistance resulting in an offset-free, wide fixing zone having a temperature of above 160° C. and up to about 240° C., such as from about 161° C. up to about 240° C. (for a wide fixing zone range of about 79° C. ), especially from about 162° C. or more especially from about 163° C. and still more especially from about 164° C. or 165° C., up to about 240° C. (for a wide fixing zone range of correspondingly about 78° C., 77° C., 76° C. or 75° C. ), and in conjunction therewith has an initial chargeability (amount of initial blowoff charges) of at least about −15 μC/g, and more particularly at least about −20 μC/g, such as about −15 to −40 μC/g, and more particularly about −20 to −40 μC/g, or about −15 to −36 μC/g, and more particularly about −20 to −36 μC/g, and desirably has an initial chargeability for standard conditions of about −17 to −36 μC/g, and more particularly about −20 to −36 μC/g, for high temperature and high humidity conditions of about −17 to −34 μC/g, and more particularly about −20 to −34 μC/g, and for low temperature and low humidity conditions of about −17 to −36 μC/g, and more particularly about −20 to −36 μC/g.

Such toner comprises a coloring agent, a binder resin and a charge control agent comprising as active ingredient a calix (n) arene compound of formula I wherein x and y are each an integer of 1 or more, the sum of x and y is n, n is an integer of 4–8, and the x and y repeat units can be arranged in any order, $R^1$ and $R^2$ are each independently hydrogen; an alkyl group of 1–12 carbon atoms that is branched or unbranched; an alkenyl group of 2–12 carbon atoms that is branched or unbranched; an aralkyl group of 7–12 carbon atoms that has or does not have a substituent (e.g. optionally having a substituent selected from an alkyl group of 1–4 carbon atoms and an alkoxy group of 1–4 carbon atoms); a phenyl group that has or does not have a substituent (e.g. optionally having a substituent selected from an alkyl group of 1–4 carbon atoms, a haloalkyl group of 1–4 carbon atoms, an alkoxy group of 1–4 carbon atoms and halo); a cycloalkyl group of 4–8 ring carbon atoms; halogen; a nitro group; an amino group; an alkyl- or phenyl- substituted amino group; —$Si(CH_3)_3$ ; or —$SO_3H$;

of the n R radicals in the —OR groups, 1 to (n−1) R radicals are hydrogen and the remaining (n−1) to 1 R radicals are Z, preferably with the proviso that the number of —OR groups in which R is hydrogen is more than the number of —OR groups in which R is Z, and Z is an alkyl group that is branched or unbranched; an alkenyl group that is branched or unbranched; a phenyl group that has or does not have a substituent (e.g. optionally having a substituent selected from an alkyl group of 1–4 carbon atoms, a haloalkyl group of 1–4 carbon atoms, an alkoxy group of 1–4 carbon atoms and halo) or an aralkyl group that has or does not have a substituent (e.g. optionally having a substituent selected from an alkyl group of 1–4 carbon atoms and an alkoxy group of 1–4 carbon atoms); a cycloalkyl group; —$COR^3$ in which $R^3$ is hydrogen, an alkyl group that is branched or unbranched, an alkenyl group that is branched or unbranched, a phenyl or aralkyl group that has or does not have a substituent (e.g. optionally having a substituent selected from an alkyl group of 1–4 carbon atoms and an alkoxy group of 1–4 carbon atoms), and a cycloalkyl group; —$Si(CH_3)_3$; —$(CH_2)_mCOOR^4$ in which $R^4$ is hydrogen or a lower alkyl group and m is an integer of 1–3; —$(CH_2CH_2O)_rH$ in which r is an integer of 1–10; or

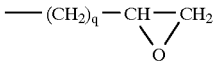

in which q is an integer of 1–10.

According to a first aspect (A) of the invention, $R^1$ and $R^2$ are the same, R in the x repeat units is hydrogen and R in the y repeat units is Z. According to a second aspect (B) thereof, $R^1$ and $R^2$ are different, R in the x repeat units is hydrogen and R in the y repeat units is Z.

According to a third aspect (C) of the invention, $R^1$ and $R^2$ are different, R in the x repeat units is hydrogen, R in (y-b) of the y repeat units is hydrogen, R in b of the y repeat units is Z and b is an integer of 1–6. According to a fourth aspect (D) thereof, $R^1$ and $R^2$ are different, R in the x repeat units is Z, R in (y-b) of the y repeat units is hydrogen, R in b of the y repeat units is Z and b is an integer of 1–6. According to a fifth aspect (E) thereof, $R^1$ and $R^2$ are different, R in (x-a) of the x repeat units is hydrogen, R in a of the x repeat units is Z, R in (y-b) of the y repeat units is hydrogen, R in b of the y repeat units is Z and a and b are each an integer of 1–5.

In the preferred case where the number of —OR groups in which R is hydrogen is more than the number of —OR groups in which R is Z (i.e. wherein more than half of the —OR groups of the 4–8 x and y repeat units are phenolic —OH groups such that less than half of the —OR groups of such x and y repeat units are —OZ groups):

per a preferred third aspect (C') of the invention b is an integer of 1–3 such that the number of —OR groups in which R is hydrogen is 3–5 and the number of —OR groups in which R is Z is 1–3;

per a preferred fourth aspect (D') of the invention b is an integer of 0–2 while x is an integer of 1–2 whereby the sum of x and b is 1–3 such that the number of —OR groups in which R is hydrogen is 3–5 and the number of —OR groups in which R is Z is 1–3;

per a preferred fifth aspect (E') of the invention a is an integer of 0–3 while b is an integer of 1–3 whereby the sum of a and b is 1–3 such that the number of —OR groups in which R is hydrogen is 3–5 and the number of —OR groups in which R is Z is 1–3.

According to a sixth aspect (F) of the invention, the charge control agent comprises a mixture of two or more calix (n) arene compounds having different x and y numbers. According to a seventh aspect (G) thereof, the charge control agent comprises a mixture of two or more calix (n) arene compounds having different numbers of —OH as —OR groups. According to an eighth aspect (H) thereof, the charge control agent comprises a mixture of two or more calix (n) arene compounds having different x and y numbers and different numbers of —OH as —OR groups.

Moreover, according to the present invention, a method is provided of developing and fixing electrostatic images with a toner which has improved fixability and offset resistance resulting in an offset-free, wide fixing zone having a temperature of above 160° C. and up to 240° C. (e.g. from about 161° C. up to about 240° C. ) and in conjunction therewith has an initial chargeability (amount of initial blowoff charges) of at least about −15 $\mu$C/g, and more particularly at least about −20 $\mu$C/g (e.g. about −17 to −40 $\mu$C/g, and more particularly about −20 to −40 $\mu$C/g) and which comprises a coloring agent, a binder resin and a charge control agent, the method comprising the steps of (1) developing an electrostatic image with said toner, and (2) fixing the developed image at a temperature of above 160° C. and up to about 240° C. (e.g. from about 161° C. up to about 240° C. ), wherein said toner contains as active ingredient of the charge control agent a calix (n) arene compound of formula I.

In particular, the toner may be used in the form of a one-component developer, or a two-component developer with a carrier.

Whereas the phenolic hydroxyl (—OH) groups in the original (starting) calix (n) arene compounds of formula A have been found to be objectionable in that the hydroxy groups interact with the binder resin and other components such as releasing agents in the toner, resulting in a narrowed fixing zone of the binder resin, by modifying some but not all of such phenolic —OH groups by —OZ groups in the original calix (n) arene compounds to provide the corresponding compounds of formula I according to the present invention, the objectionable interaction of the —OH groups with the binder resin, releasing agent, etc. is avoided by the presence of such —OZ groups while at the same time the still remaining —OH groups (e.g. more than half of the total —OR groups present) enable the so modified calix (n) arene compounds of formula I to retain the desired negative charge providing property and charge stability attributable to the presence of such —OH groups in the calix (n) arene compounds.

While specific embodiments of the invention have been shown and described in detail to illustrate the application of the principles of the invention, it will be understood that the invention may be embodied otherwise without departing from such principles.

What is claimed is:

1. Toner for developing and fixing electrostatic images, which has improved fixability and offset resistance resulting in an offset-free, wide fixing zone having a temperature of above 160° C. and up to about 240° C. and in conjunction therewith has an initial chargeability of at least about −15 μC/g upon triboelectrical charging with an iron powder carrier and which comprises a coloring agent, a binder resin and a charge control agent comprising as active ingredient a calix (n) arene compound of formula I:

I

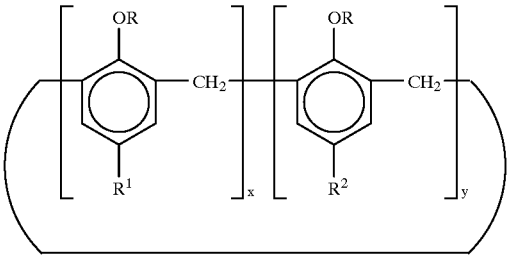

wherein x and y are each an integer of 1 or more, the sum of x and y is n, n is an integer of 6 or 8, and the x and y repeat units can be arranged in any order, $R^1$ and $R^2$ are each independently hydrogen; an alkyl group of 1–12 carbon atoms that is branched or unbranched; an alkenyl group of 2–12 carbon atoms that is branched or unbranched; an aralkyl group of 7–12 carbon atoms that has or does not have a substituent; a phenyl group that has or does not have a substituent; a cycloalkyl group of 4–8 ring carbon atoms; halogen; a nitro group; an amino group; an alkyl- or phenyl- substituted amino group; —$Si(CH_3)_3$; or —$SO_3H$;

of the n R radicals in the —OR groups, 1 to (n−1) R radicals are hydrogen and the remaining (n−1) to 1 R radicals are Z, and Z is an alkyl group having 1–4 carbon atoms that is branched or unbranched; an allyl group; a benzyl group; an acetyl group; or

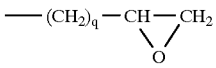

in which q is an integer of 1–10.

2. Toner of claim 1 wherein the number of —OR groups in which R is hydrogen is more than the number of —OR groups in which R is Z.

3. Method of developing and fixing electrostatic images with a toner which has improved fixability and offset resistance resulting in an offset-free, wide fixing zone having a temperature of above 160° C. and up to about 240° C. and in conjunction therewith has an initial chargeability of at least about −15 μC/g upon triboelectrical charging with an iron powder carrier and which comprises a coloring agent, a binder resin and a charge control agent, said method comprising developing an electrostatic image with said toner and fixing the developed image at a temperature of above 160° C. and up to about 240° C., wherein said toner is the toner of claim 2.

4. Toner of claim 1 wherein $R^1$ and $R^2$ are the same, R in the x repeat units is hydrogen and R in the y repeat units is Z.

5. Toner of claim 1 wherein $R^1$ and $R^2$ are different, R in the x repeat units is hydrogen and R in the y repeat units is Z.

6. Toner of claim 1 wherein the charge control agent comprises a mixture of two or more calix (n) arene compounds having different x and y numbers.

7. Toner of claim 1 wherein the charge control agent comprises a mixture of two or more calix (n) arene compounds having different numbers of —OH as —OR groups.

8. Toner of claim 1 wherein the charge control agent comprises a mixture of two or more calix (n) arene compounds having different x and y numbers and different numbers of —OH as —OR groups.

9. Toner of claim 1 wherein said calix (n) arene compound is present in an amount by weight of about 0.1–10 parts per 100 parts of said binder resin.

10. Toner for developing and fixing electrostatic images, which has improved fixability and offset resistance resulting in an offset-free, wide fixing zone having a temperature of from about 161° C. up to about 240° C. and in conjunction therewith has an initial chargeability of about −15 to −40 μC/g upon triboelectrical charging with an iron powder carrier and which comprises a coloring agent, a binder resin and a charge control agent comprising as active ingredient a calix (n) arene compound of formula I:

I

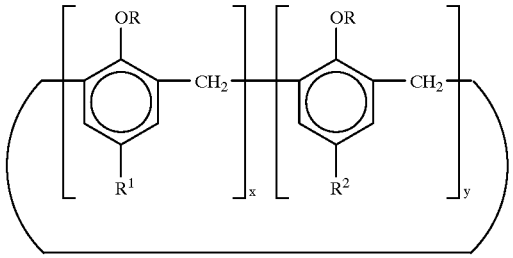

wherein x and y are each an integer of 1 or more, the sum of x and y is n, n is an integer of 6 or 8, and the x and y repeat units can be arranged in any order, $R^1$ and $R^2$ are each independently hydrogen; an alkyl group of 1–12 carbon atoms that is branched or unbranched; an alkenyl group of 2–12 carbon atoms that is branched or unbranched; an aralkyl group of 7–12 carbon atoms optionally having a substituent selected from the group consisting of an alkyl group of 1–4 carbon atoms and an alkoxy group of 1–4 carbon atoms; a phenyl group optionally having a substituent selected from the group consisting of an alkyl group of 1–4 carbon atoms, a haloalkyl group of 1–4 carbon atoms, an alkoxy group of 1–4 carbon atoms and halo; a cycloalkyl group of 4–8 ring carbon atoms; halo; nitro; amino; an alkyl- or phenyl-substituted amino group; —$Si(CH_3)_3$; or —$SO_3H$;

of the n R radicals in the —OR groups, 1 to (n−1) R radicals are hydrogen and the remaining (n−1) to 1 R radicals are Z, with the proviso that the number of —OR groups in which R is hydrogen is more than the number of —OR groups in which R is Z, and Z is an alkyl group having 1–4 carbon atoms that is branched or unbranched; an allyl group; a benzyl group; an acetyl group; or

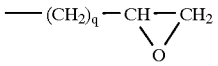

in which q is an integer of 1–10.

11. Toner of claim 10 wherein $R^1$ and $R^2$ are the same, R in the x repeat units is hydrogen and R in the y repeat units is Z.

12. Toner of claim 10 wherein $R^1$ and $R^2$ are different, R in the x repeat units is hydrogen and R in the y repeat units is Z.

13. Toner of claim 10 wherein the charge control agent comprises a mixture of two or more calix (n) arene compounds having different x and y numbers.

14. Toner of claim 10 wherein the charge control agent comprises a mixture of two or more calix (n) arene compounds having different numbers of —OH as —OR groups.

15. Toner of claim 10 wherein the charge control agent comprises a mixture of two or more calix (n) arene compounds having different x and y numbers and different numbers of —OH as —OR groups.

16. Toner of claim 10 wherein said calix (n) arene compound is present in an amount by weight of about 0.1–10 parts per 100 parts of said binder resin.

17. Method of developing and fixing electrostatic images with a toner which has improved fixability and offset resistance resulting in an offset-free, wide fixing zone having a temperature of above 160° C. and up to about 240° C. and in conjunction therewith has an initial chargeability of at least about −15 $\mu$C/g upon triboelectrical charging with an iron powder carrier and which comprises a coloring agent, a binder resin and a charge control agent, said method comprising developing an electrostatic image with said toner and fixing the developed image at a temperature of above 160° C. and up to about 240° C., wherein said toner contains as active ingredient of the charge control agent a calix (n) arene compound of formula I:

I

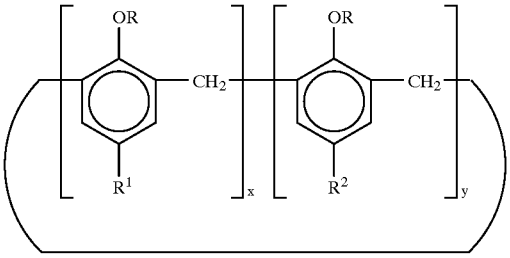

wherein x and y are each an integer of 1 or more, the sum of x and y is n, n is an integer of 6 or 8, and the x and y repeat units can be arranged in any order, $R^1$ and $R^2$ are each independently hydrogen; an alkyl group of 1–12 carbon atoms that is branched or unbranched; an alkenyl group of 2–12 carbon atoms that is branched or unbranched; an aralkyl group of 7–12 carbon atoms that has or does not have a substituent; a phenyl group that has or does not have a substituent; a cycloalkyl group of 4–8 ring carbon atoms; halogen; a nitro group; an amino group; an alkyl- or phenyl-substituted amino group; —$Si(CH_3)_3$; or —$SO_3H$;

of the n R radicals in the —OR groups, 1 to (n−1) R radicals are hydrogen and the remaining (n−−1) to 1 R radicals are Z, and Z is an alkyl group having 1–4 carbon atoms that is branched or unbranched; an allyl group; a benzyl group; an acetyl group; or

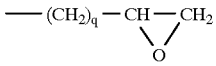

in which q is an integer of 1–10.

18. Method of claim 17 wherein said toner is in the form of a one component developer.

19. Method of claim 17 wherein said toner is in the form of a two component developer with a carrier.

20. Method of developing and fixing electrostatic images with a toner which has improved fixability and offset resistance resulting in an offset-free, wide fixing zone having a temperature of from about 161° C. up to about 240° C. and in conjunction therewith has an initial chargeability of about −15 to −40 $\mu$C/g upon triboelectrical charging with an iron powder carrier and which comprises a coloring agent, a binder resin and a charge control agent, said method comprising developing an electrostatic image with said toner and fixing the developed image at a temperature of from about 161° C. up to about 240° C., wherein said toner contains as active ingredient of the charge control agent a calix (n) arene compound of formula I:

I

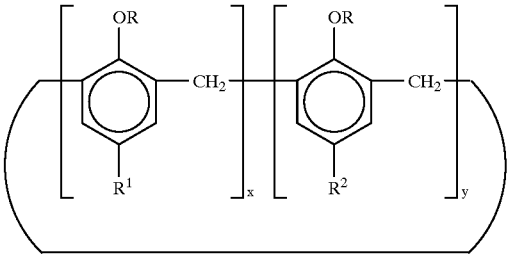

wherein x and y are each an integer of 1 or more, the sum of x and y is n, n is an integer of 6 or 8, and the x and y repeat units can be arranged in any order, $R^1$ and $R^2$ are each independently hydrogen; an alkyl group of 1–12 carbon atoms that is branched or unbranched; an alkenyl group of 2–12 carbon atoms that is branched or unbranched; an aralkyl group of 7–12 carbon atoms optionally having a substituent selected from the group consisting of an alkyl group of 1–4 carbon atoms and an alkoxy group of 1–4 carbon atoms; a phenyl group optionally having a substituent selected from the group consisting of an alkyl group of 1–4 carbon atoms, a haloalkyl group of 1–4 carbon atoms, an alkoxy group of 1–4 carbon atoms and halo; a cycloalkyl group of 4–8 ring carbon atoms; halo; nitro; amino; an alkyl- or phenyl-substituted amino group; —$Si(CH_3)_3$; or —$SO_3H$;

of the n R radicals in the —OR groups, 1 to (n−1) R radicals are hydrogen and the remaining (n−1) to 1 R radicals are Z, with the proviso that the number of —OR groups in which R is hydrogen is more than the number of —OR groups in which R is Z, and Z is an alkyl group having 1–4 carbon atoms that is branched or unbranched; an allyl group; a benzyl group; an acetyl group; or

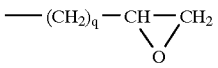

in which q is an integer of 1–10.

21. Method of claim 20 wherein said toner is in the form of a one component developer.

22. Method of claim 20 wherein said toner is in the form of a two component developer with a carrier.

23. Toner for developing and fixing electrostatic images, which has improved fixability and offset resistance resulting in an offset-free, wide fixing zone having a temperature of above 160° C. and up to about 240° C. and which comprises a coloring agent, a binder resin and a charge control agent comprising as active ingredient a calix (n) arene compound of formula I:

I

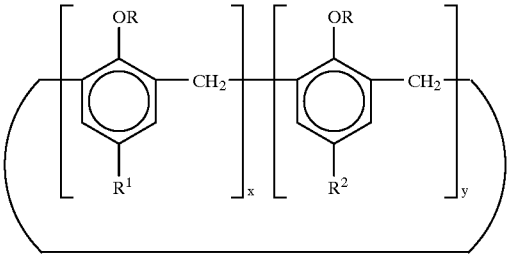

wherein x and y are each an integer of 1 or more, the sum of x and y is n, n is an integer of 6 or 8, and the x and y repeat units can be arranged in any order, $R^1$ and $R^2$ are each independently hydrogen; an alkyl group of 1–12 carbon atoms that is branched or unbranched; an alkenyl group of 2–12 carbon atoms that is branched or unbranched; an aralkyl group of 7–12 carbon atoms that has or does not have a substituent; a phenyl group that has or does not have a substituent; a cycloalkyl group of 4–8 ring carbon atoms; halogen; a nitro group; an amino group; an alkyl- or phenyl-substituted amino group; —$Si(CH_3)_3$; or —$SO_3H$;

of the n R radicals in the —OR groups, 1 to (n−1) R radicals are hydrogen and the remaining (n−1) to 1 R radicals are Z, and Z is an alkyl group having 1–4 carbon atoms that is branched or unbranched; an allyl group; a benzyl group; an acetyl group; or

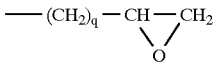

in which q is an integer of 1–10.

24. Method of developing and fixing electrostatic images with a toner which has improved fixability and offset resistance resulting in an offset-free, wide fixing zone having a temperature of above 120° C. and up to about 240° C. and which comprises a coloring agent, a binder resin and a charge control agent, said method comprising developing an electrostatic image with said toner and fixing the developed image at a temperature of above 160° C. and up to about 240° C., wherein said toner contains as active ingredient of the charge control agent a calix (n) arene compound of formula I:

I

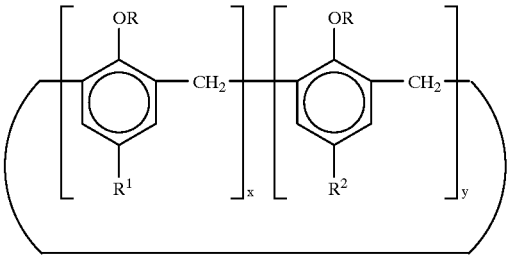

wherein x and y are each an integer of 1 or more, the sum of x and y is n, n is an integer of 6 or 8, and the x and y repeat units can be arranged in any order, $R^1$ and $R^2$ are each independently hydrogen; an alkyl group of 1–12 carbon atoms that is branched or unbranched; an alkenyl group of 2–12 atoms that is branched or unbranched; an aralkyl group of 7–12 atoms that has or does not have a substituent; a phenyl group that has or does not have a substituent; a cycloalkyl group of 4–8 ring carbon atoms; halogen; a nitro group; an amino group; an alkyl- or phenyl-substituted amino group; —$Si(CH_3)_3$; or —$SO_3H$;

of the n R radicals in the —OR groups, 1 to (n−1) R radicals are hydrogen and the remaining (n−1) to 1 R radicals are Z, and Z is an alkyl group having 1–4 carbon atoms that is branched or unbranched; an allyl group; a benzyl group; an acetyl group; or

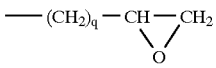

in which q is an integer of 1–10.

* * * * *